US010731437B1

(12) United States Patent
Saraya

(10) Patent No.: US 10,731,437 B1
(45) **Date of Patent: *Aug. 4, 2020**

(54) METHODS AND SYSTEMS FOR FRACING

(71) Applicant: Vertice Oil Tools, Missouri City, TX (US)

(72) Inventor: Mohamed Saraya, Sugar Land, TX (US)

(73) Assignee: Vertice Oil Tools, Missouri City, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/670,378

(22) Filed: Oct. 31, 2019

Related U.S. Application Data

(63) Continuation of application No. 16/433,814, filed on Jun. 6, 2019, now Pat. No. 10,502,026, which is a continuation-in-part of application No. 16/271,318, filed on Feb. 8, 2019, now Pat. No. 10,352,128.

(51) Int. Cl.

| | |
|---|---|
| ***E21B 33/12*** | (2006.01) |
| ***E21B 43/26*** | (2006.01) |
| ***E21B 34/06*** | (2006.01) |
| ***E21B 34/10*** | (2006.01) |
| ***E21B 33/129*** | (2006.01) |
| *E21B 34/00* | (2006.01) |

(52) U.S. Cl.
CPC ..... *E21B 34/10* (2013.01); *E21B 33/12* (2013.01); *E21B 33/1293* (2013.01); *E21B 34/063* (2013.01); *E21B 43/26* (2013.01); *E21B 2034/005* (2013.01)

(58) Field of Classification Search
CPC .... E21B 33/12; E21B 33/1208; E21B 33/134; E21B 2034/005; E21B 34/063; E21B 43/26
See application file for complete search history.

(56) References Cited

U.S. PATENT DOCUMENTS

| | | | | |
|---|---|---|---|---|
| 10,352,128 | B1 * | 7/2019 | Saraya | E21B 43/26 |
| 10,502,026 | B1 * | 12/2019 | Saraya | E21B 33/1293 |
| 2013/0014958 | A1 * | 1/2013 | Jani | E21B 43/26 166/386 |
| 2018/0051532 | A1 * | 2/2018 | Smith | E21B 33/134 |

* cited by examiner

*Primary Examiner* — Zakiya W Bates
(74) *Attorney, Agent, or Firm* — Pierson Intellectual Property LLC

(57) ABSTRACT

A frac plug with a flapper, wherein the flapper is configured to set and unset based on a pressure differential and/or fluid flow associated with the frac plug.

21 Claims, 9 Drawing Sheets

METHODS AND SYSTEMS FOR FRACING

BACKGROUND INFORMATION

Field of the Disclosure

Example of the present disclosure relate to a frac plug. More specifically, embodiments are directed towards a frac plug with a moveable flapper or disc (referred to hereinafter collectively and individually as "flapper"), wherein the moveable flapper is configured to seal and unseal based on a pressure differential and/or a direction of fluid flow associated with the frac plug.

Background

A frac plug is a tool that is set downhole to isolate portions of a wellbore. Frac plugs are typically set by pumping it using a driving fluid through the wellbore. Once in place, the frac plug may be set using a running/setting tool. Setting the frac plug may include expanding slips or seals for anchoring and sealing of the frac plug, respectively. Once anchored and sealed, a perforation application may take place above the frac plug, so as to provide perforations through the casing in the isolated section of the wellbore above the frac plug. This process is then completed multiple times with different frac plugs from the toe to the heel of the well until the casing and formation have been configured and frac operation has been repeated as desired.

Unfortunately, unlike setting of the frac plug, it is difficult to remove a frac plug from a wellbore. As a result, removal of a frac plug requires drilling out/milling the frac plug from the wellbore. In horizontal sections of a well, this task can be rather difficult. Furthermore, unlike the initial positioning of the frac plug, conventional frac plugs are either plugged which prohibit the ability to re-pump another plug in case the communication perforation cannot be established above, or it requires a drop and pumping of a ball at the top of the plug which consume excessive amount of fluid.

Further during milling of frac plugs and once the slips are milled, the bottom parts of the frac plug can't be further milled due to spinning. While spinning, the frac plug is pushed down to a lower plug and more weight is exerted on it to allow milling before milling the lower plug. However, this method consumes time.

Accordingly, needs exist for system and methods utilizing a frac plug with a flapper, wherein the flapper is configured to set and unset based on a pressure differential and/or fluid flow associated with the frac plug, and wherein the flapper seat can be removed or a communication through it can be established by designing the flapper with a weak point, this functionality can be achieved using a pressure differential in case of failure of achieving perforation above the flapper. In embodiments, removal of the flapper seat or creating a weak point through the flapper may establish communication with perforation below the frac plug allowing pumping a new frac plug or new perforation if required.

SUMMARY

Embodiments disclosed herein describe a frac plug with a movable flapper, wherein the flapper is configured to close based on a pressure differential and/or fluid flow from a proximal end towards a distal end of the frac plug, and the flapper is configured to open based on the pressure and/or fluid flow from the distal end towards the proximal end of the frac plug. The frac plug may include a rupture disc that is configured to shear at a pre-determined pressure. This may allow communication across the frac plug, even if the flapper is closed.

The frac plug may include an outer mandrel, an inner mandrel, a movable flapper, and a rupture disc.

The outer mandrel may be configured to be positioned outside and adjacent to the inner mandrel, wherein the outer mandrel and the inner mandrel may be coupled together via threads, shear screws or any other method. The outer mandrel may include a pump down element, expandable members, and slips. In other embodiments, the outer mandrel may be referred to as an upper mandrel, while the lower mandrel may be referred to as a lower mandrel.

The pump down element may be a device that is configured to extend away from the outer circumference of the outer mandrel, and receive fluid flow between a casing and the outer mandrel. The pump down element may have a force acted upon it by the flowing fluid through an annulus, which may be utilized to move the frac plug towards a distal end of the wellbore.

The expandable members may be sealing elements that are configured to be set to extend across an annulus between the outer mandrel and the casing. The expandable members may be configured to compress and extend across the annulus responsive to the outer mandrel being positioned at a desired location and/or based on a fluid flow rate through the annulus. Responsive to the expandable members being set, the frac plug may be set in place.

The slips may be configured to couple the frac plug with a casing and/or other elements to limit the rotation and axial movement of the frac plug during fracing and milling. The slips may be configured to compress and radially expand.

The inner mandrel may be a hollow chamber that is positioned adjacent to, and within the outer mandrel. The inner mandrel may be configured to house a flapper seat, a hinge, and the moveable flapper. In another embodiment, the flapper seat, a hinge, and the moveable flapper may be housed in the outer mandrel.

The flapper seat may be configured to receive the moveable flapper when the moveable flapper is positioned in a first position, wherein in the first position the moveable flapper closes the hollow chamber.

The hinge may be a mechanical bearing, a torsion spring or just a rod that is configured to couple the inner mandrel and the moveable flapper, and allow the moveable flapper to rotate. In embodiments, the hinge may provide a force against the moveable flapper that retains the moveable flapper in a first position if no other forces are applied to the movable flapper, while assisting the moveable flapper to move from the first position to the second position if fluid flows in the inner mandrel from the distal end towards the proximal end. The hinge may be mounted inside of the bore of the frac plug to prevent a full opening or leaning of the flapper on a horizontal section of the wellbore and outside of the flow path, preventing re-closure of the flapper.

The moveable flapper may be a seal, stopper, wall, disc etc. that is configured to move between a first position and a second position. The moveable flapper may include a passageway that is configured to house a rupture disc, a shear pin or any other device that actuates and open by pressure differential, which will be collectively referred to as rupture disc thereafter wherein the passageway extends from a first surface of the moveable flapper to a second surface of the movable flapper. The passageway may be positioned at an angle that is in parallel or not in parallel to a longitudinal axis of the flapper to control to direction of the flow of fluid through frac plug. This may allow for the fluid to flow in a direction substantially the same as the central axis of the tool, or be directed towards the inner circumference of the inner mandrill. In an embodiment, the passageway may be configured to be positioned parallel to the central axis of the frac plug when the moveable flapper is in the first position, and not in parallel to the central axis of the frac plug when the moveable flapper is in the second position. In another embodiment, the rupture disc can be positioned on the inner mandrel or the outer mandrel. The movable flapper may move to the second position based on forces created by flowing fluid from the distal end of the frac plug to the proximal end of the frac plug directly interacting with a lower surface of the moveable flapper to move the flapper.

The rupture disc may be configured to shear, rupture, be removed responsive to a pre-determined pressure threshold. The pressure threshold may be greater than a fracturing pressure of a formation above the frac plug, and lower than a pressure rating of the frac plug itself. As such, the rupture disc may create a weak point within the frac plug. This may be utilized for a contingency plan in case of a perforation gun misfire, while allowing for communications through the frac plug through the sheared rupture disc. In the first position and while the rupture disc is intact, the moveable flapper may be configured to seal a distal end of the frac plug. Responsive to the rupture disc being sheared, there may be communication across the moveable flapper even when the moveable flapper is in the first position. In the second position, the moveable flapper may be configured to allow the flow of fluid from the distal end of the frac plug towards the proximal end of the frac plug.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
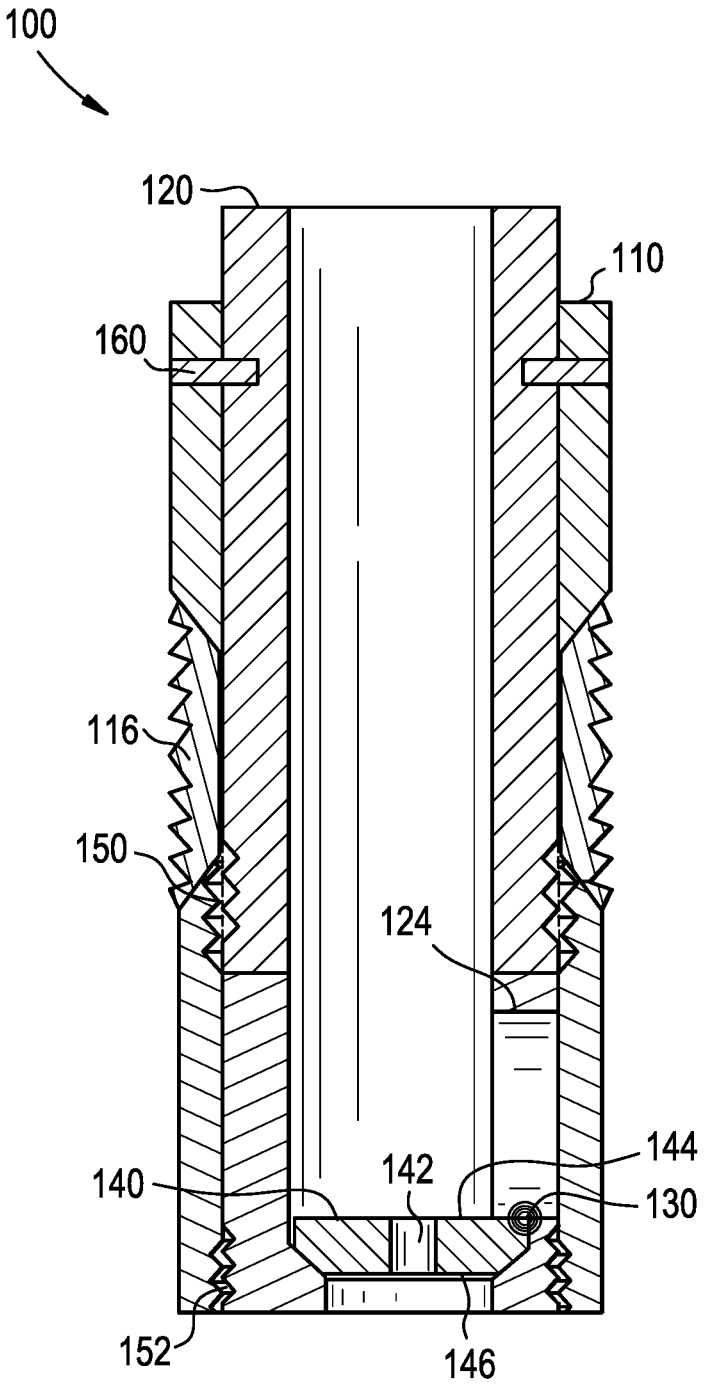
FIG. 1 depicts a frac plug, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

Turning now to FIG. 1, FIG. 1 depicts a frac plug 100, according to an embodiment. The material of the frac plug components can be made of any material, including, cast iron, composite, dissolvable or steel, further, more than one material can be used to build the components of the frac plug 100.

Frac plug 100 may be configured to selectively seal a distal end of frac plug 100 to increase pressure within a wellbore based on a direction of fluid flowing through the frac plug, wherein frac plug 100 may operate with or without a frac ball. After a rupture disc positioned through a flapper seat is sheared, frac plug 100 may have a low pressure drop for a low pressure rate that is sufficient to pump another frac plug above frac plug 100. However, at higher flow rates during fracturing, frac plug 100 with a ruptured disc may act as a choking point, creating a high differential that prevents significant flow rate traversing the flapper seat.

Frac plug 100 may be comprised of any desired material or a combination of different materials, such as steel, composite, etc. Frac plug 100 may include an outer mandrel 110, inner mandrel 120, hinge 130, and movable flapper 140.

Outer mandrel 110 may be configured to be positioned outside and adjacent to inner mandrel 120, wherein outer mandrel 110 and inner mandrel 120 may be coupled together via threads 150, 152 and/or shear screws 160. Threads 150, 152 may be configured to couple the mandrels together, and provide anti-rotation segments for milling. The threads 150, 152 may be positioned above and/or below moveable flapper 140. Shear screws 160 may be configured to decouple outer mandrel 110 and inner mandrel 120 based on a pressure and/or fluid flow rate. Responsive to the pressure and/or fluid flow rate in an annulus between frac plug 100 and a casing increasing past a threshold, the shear screws 160 may break. This may allow outer mandrel 110 to compress.

Slips 116 may be configured to couple frac plug 100 with a casing and/or other elements. This may lock frac plug 100 in place, and also limit the rotation of frac plug 100 during milling. In embodiments, slips 116 may be configured to radially expand to fix outer mandrel 110 in place. The slips 116 may be formed of any type of materials, such as composite, metals, carbide, ceramic etc. In embodiments, slips 116 may be configured to be eroded away due to pressurizing sand exiting the rupture disc at high velocity to interact with slips at an angle. This may cause slips 116 to erode, such that frac plug 100 may be removed.

Inner mandrel 120 may be positioned adjacent to and within outer mandrel 110. A proximal end of inner mandrel 120 projects away from a proximal end of outer mandrel 110, such that the proximal ends are not flush. Inner mandrel 120 may include an indentation 124, flapper seat 126. In another embodiment, indentation 124 may be in the outer mandrel 110. In a further embodiment, the indentation 124 may be totally removed, this should create more restriction to the flapper 140 movement in second position, further preventing flapper from fully opening, and not allowing flapper 140 to be positioned in parallel to a central axis of the frac plug 100.

Indentation 124 may be a depression, notch, cutout, etc. positioned within a sidewall of inner mandrel 120. This may increase the inner diameter across inner mandrel 120. Indentation 124 may be configured to house moveable flapper 140 when moveable flapper 140 is in the second position. While in the second position, a first end of moveable flapper may be substantially flush with an inner diameter of inner mandrel 120 but not fully flush, such that fluid may flow through a hollow chamber through frac plug 100 without moving flapper 140 back to the first position when flowing from distal end to proximal end of the plug.

Flapper seat 126 may be positioned below a distal end of indentation 124. Flapper seat 126 may be any type of device that is configured to secure and house moveable flapper 140 while moveable flapper is in a first position. Furthermore, flapper seat 126 may be configured to limit the rotation of moveable flapper 140, such that a second end of moveable flapper 140 is positioned in a direction to allow flow in the direction of the axis of frac plug 100. In embodiments, flapper seat 126 may include a tapered, angled, sloped, etc. circumference that is configured to decrease the inner diameter of inner mandrel 120 from the first end of flapper seat 126 to a second end of flapper seat 126. The changing of diameter may allow moveable flapper 140 to be positioned on flapper seat 126 in the second position, and form a seal across the inner diameter of inner mandrel 120. Flapper seat 126 may be coupled to frac plug at any location between the proximal and distal ends of frac plug 100 via a plurality of different mechanisms, such as threads, shearing devices, etc. In embodiments, where flapper seat 126 is selectively coupled to frac plug 100 via shearing devices, flapper seat 126 may be decoupled from frac plug 100. Flapper seat 126 may be decoupled from frac plug 100 based on a pressure applied to flapper seat 126 from fluid flowing from the proximal end to the distal end of frac plug 100. Once the pressure applied is above a shearing threshold, flapper seat 126 may be decoupled from frac plug 100, and allow for communication with zones below frac plug 100. If it is desired to seal frac plug 100 without the use of moveable flapper 140, frac ball may positioned on the proximal end of inner mandrel 120 to create a seal across the inner diameter of frac plug 100.

Hinge 130 may be a mechanical bearing or a torsion spring that is configured to couple inner mandrel 120 and moveable flapper 140, and allow moveable flapper 140 to rotate. In embodiments, hinge 130 may provide a force against moveable flapper 140 that moves moveable flapper 140 towards the first position if no other forces are applied to moveable flapper 140, while assisting moveable flapper 140 to move from the first position to the second position if fluid flows in the inner mandrel 120 from the distal end towards the proximal end of frac plug 100. However, in other embodiments, hinge 130 may be a net neutral hinge that exerts no or limited forces against moveable flapper 140.

Moveable flapper 140 may be a seal, stopper, wall, etc. that is configured to move between a first position and a second position. In the first position, moveable flapper 140 may be configured to seal a distal end of frac plug 100 when seated on flapper seat 126. In the second position, moveable flapper 140 may be positioned with indentation and be configured to allow the flow of fluid from the distal end of frac plug towards the proximal end of frac plug 100. In embodiments, moveable flapper 140 may be any type of device that is has a diameter that is smaller than that of a first end of flapper seat 126 but is larger than that of a second end of flapper seat 126, such that moveable flapper 140 may form a seal within frac plug at a location aligned with flapper seat 126. For example, in embodiments, moveable flapper 140 may be disc shaped or half ball shaped and may not be coupled to inner mandrel 120 via hinge 130. However, in other embodiments, moveable flapper 140 may be a butterfly flapper with either one or two independent parts that each have first ends coupled to inner mandrel 120 at opposite sides of flapper seat 126, and when in the first position the second ends of the independent parts are overlaid over each other to form a seal.

Moveable flapper 140 may include a rupture disc 142 positioned in a passageway, wherein the passageway extends from a first surface 144 of flapper 140 to a second surface of flapper 140. The passageway may have a diameter that is less than that across inner mandrel 120. Rupture disc 142 may be configured to shear, dissolve, or otherwise be removed from the passageway responsive to a pressure differential between first surface 144 and second surface 146 being greater than a pre-determined amount. When rupture disc 142 is removed from the passageway, communication may occur across flapper 140 even if flapper 140 is in the second position. If it is desired to seal frac plug 100 without after shearing the rupture disc 142 on moveable flapper 140, a frac ball may positioned on the proximal end of inner mandrel 120 to create a seal across the inner diameter of frac plug 100. Alternatively, the frac ball may be configured to be positioned on over the passageway through the flapper to create a seal.

As depicted in FIG. 1, when frac plug 100 is being run in hole, the fluid flowing through the inner diameter inner mandrel 120 may position flapper 140 in the first position with an intact rupture disc 142. By flapper 140 creating a seal across frac plug 100 while being run in hole, the amount of pumping fluid required to move frac plug 100 downhole may be reduced.

Figure 2:
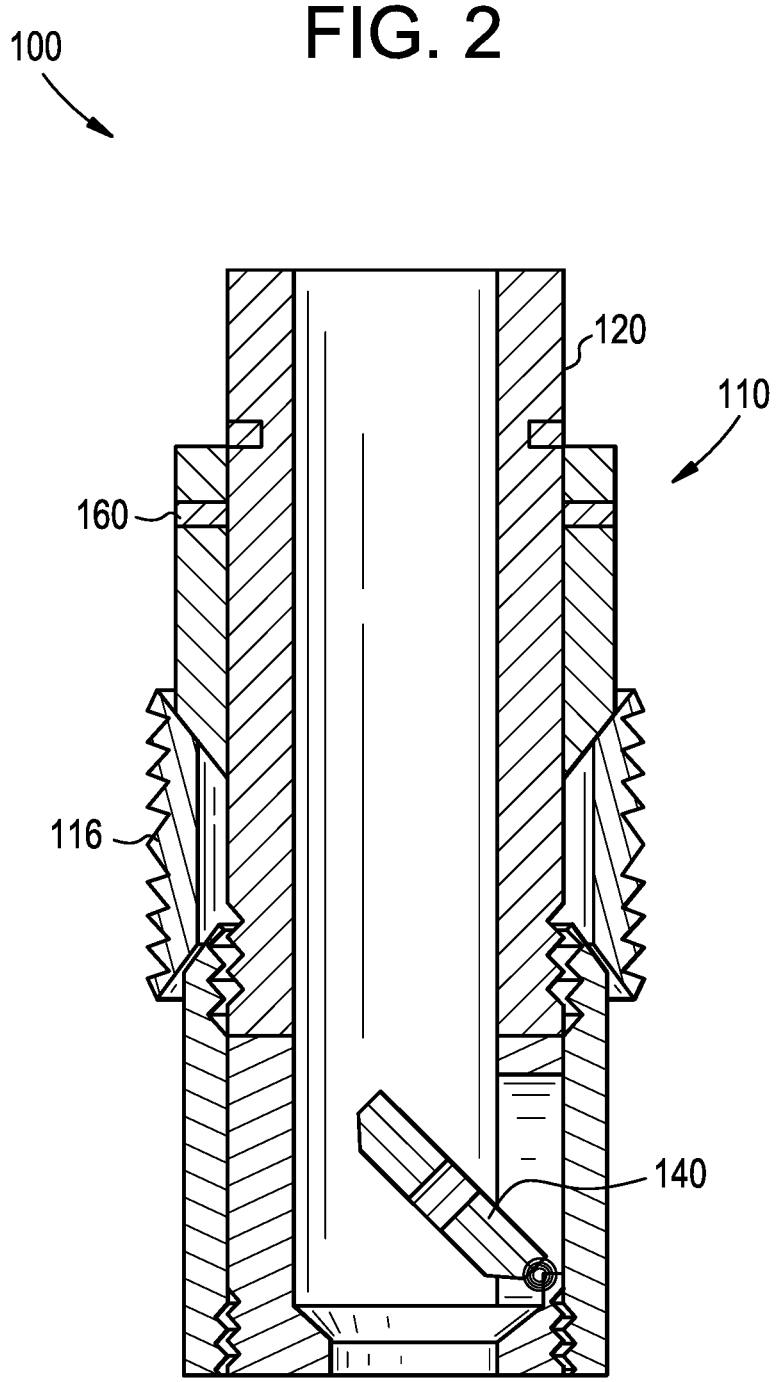
FIG. 2 depicts a frac plug, according to an embodiment.

FIG. 2 depicts frac plug 100, according to an embodiment. Elements depicted in FIG. 2 may be described above, and for the sake of brevity another description of these elements may be omitted. More specifically, FIG. 2 may depict frac plug 100 when it is initially set.

When frac plug 100 is initially set, a pressure applied against outer mandrel 110 may be sufficient to shear pins 160. This may enable outer mandrel 110 to be decoupled from inner mandrel 120, and move towards a distal end of frac plug 100. Responsive to outer mandrel 110 moving, slip 116 may radially expand and couple frac plug 100 to an outer element, such as casing. In embodiments where frac plug 100 is in a horizontal section of the well, flapper 140 may be held in place between the first position and the second position. This may be due to gravitational forces, forces generated by hinge 130, fluid flowing from distal end to proximal end through the inner diameter of frac plug 100, etc. being applied to flapper 140. By retaining flapper 140 in a position between the first position and the second position, communication through frac plug 100 may be possible. Yet, responsive to fluid flowing from the proximal end of tool 100 towards the distal end of tool 100, flapper 140 may form a seal across frac plug 100.

Figure 3:
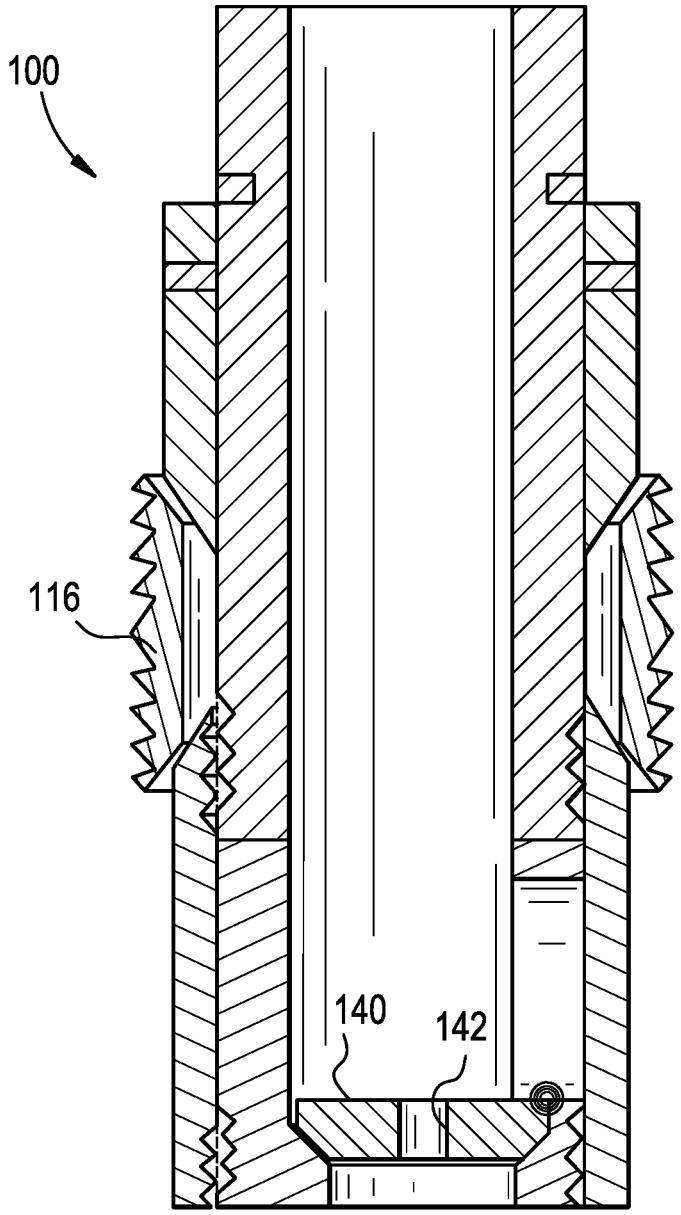
FIG. 3 depicts a frac plug, according to an embodiment.

FIG. 3 depicts frac plug 100, according to an embodiment. Elements depicted in FIG. 3 may be described above, and for the sake of brevity another description of these elements may be omitted. More specifically, FIG. 3 may depict frac plug 100 when flapper 140 is set to form a seal.

As depicted in FIG. 3, as fluid flows from the proximal end towards the distal end of frac plug 100, flapper 140 may extend across the inner diameter of frac plug 100 to form a seal. This may form a seal isolating a first area of frac plug 100 positioned above flapper 140 from a second area of frac plug positioned below flapper 140.

Forming the seal isolating the first area of frac plug 100 from the second area allows pressure to within the first area to increase until a pre-determined pressure threshold that will burst rupture disc 142, wherein the pre-determined pressure threshold is greater than the pressure required for a fracturing operation above frac plug 100. This may create a closed system that is fluidly locked due to the seal formed by flapper 140.

Figure 4:
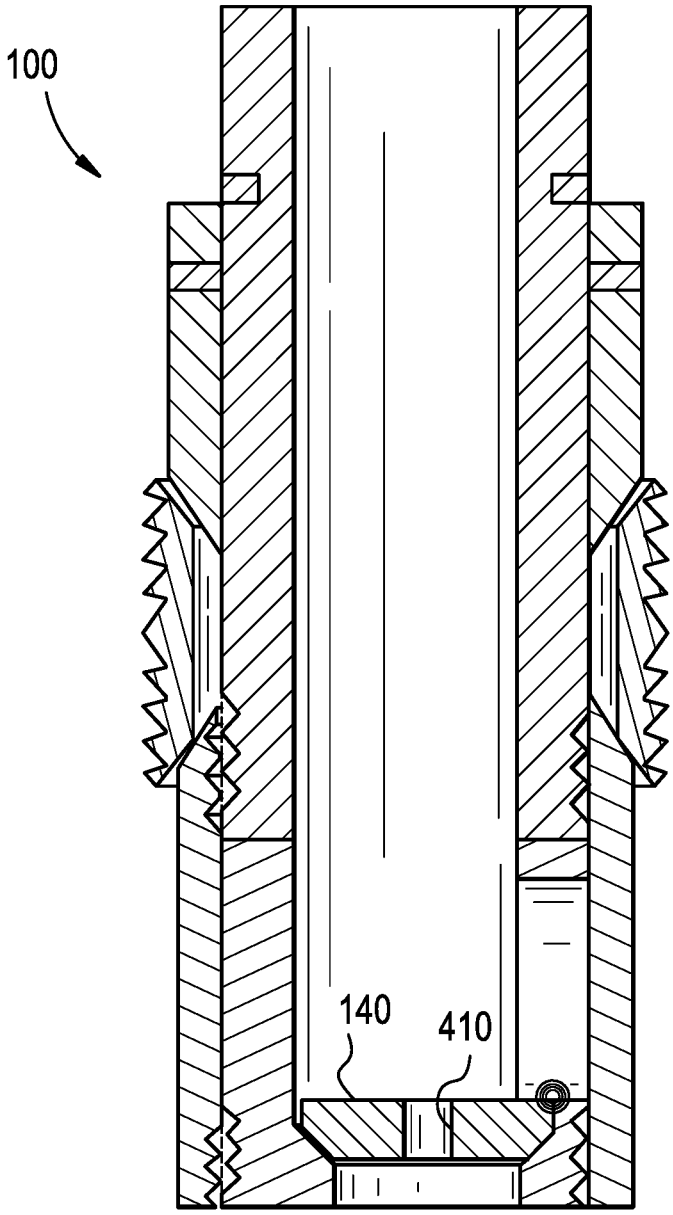
FIG. 4 depicts a frac plug, according to an embodiment.
Figure 5:
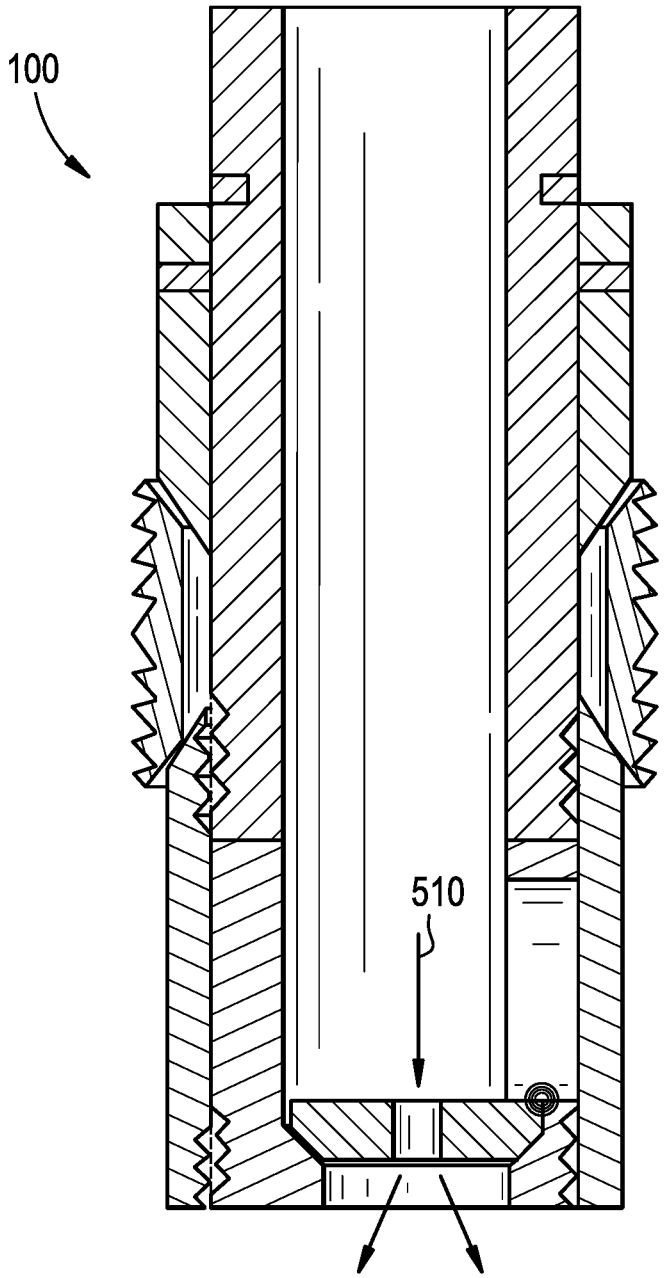
FIG. 5 depicts a frac plug, according to an embodiment.

FIGS. 4-5 depicts frac plug 100, according to an embodiment. Elements depicted in FIGS. 4-5 may be described above, and for the sake of brevity another description of these elements may be omitted.

As depicted in FIG. 4, responsive to increasing the pressure within the first area to be greater than a pressure threshold, rupture disc 142 may rupture to expose passageway 410. This may break the closed system, allowing for communication of fluid through frac plug 100 to the perforation below.

As depicted in FIG. 5, when passageway 410 is exposed, then communication between the first area and the second area may be established. The communication may occur when flapper 140 is in the first position without having to reset or move flapper 140 to the second position. This may allow fluid 510 to move new tools towards the distal end of the wellbore without creating a fluid lock.

Figure 6:
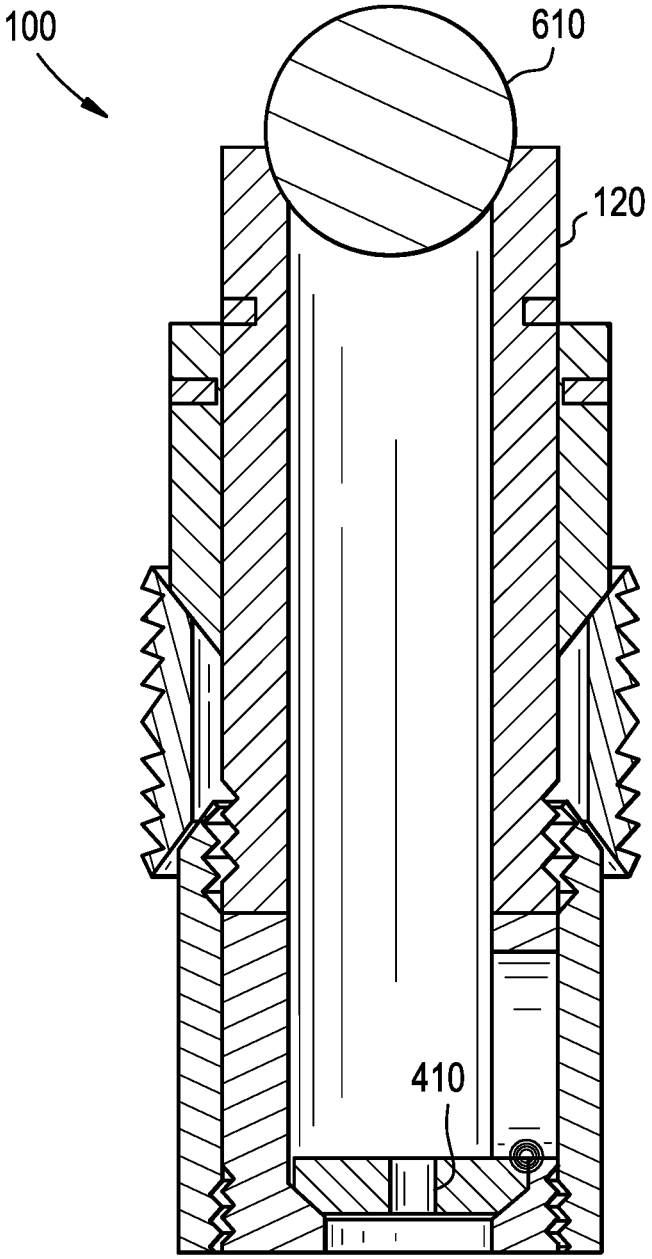
FIG. 6 depicts a frac plug, according to an embodiment.

FIG. 6 depicts frac plug 100, according to an embodiment. Elements depicted in FIG. 6 may be described above, and for the sake of brevity another description of these elements may be omitted.

As depicted in FIG. 6, responsive to exposing passageway 410 it may be necessary to form a secondary seal across the inner diameter of frac plug 100. As such, it may be desired to drop a ball 610, object, disc, etc. within frac plug 100. Ball 610 may be configured to be positioned on a proximal end of inner mandrel 120, and may isolate areas above ball 610 from areas below ball 620. This may allow frac plug 100 to operate as a conventional frac plug.

Figure 7:
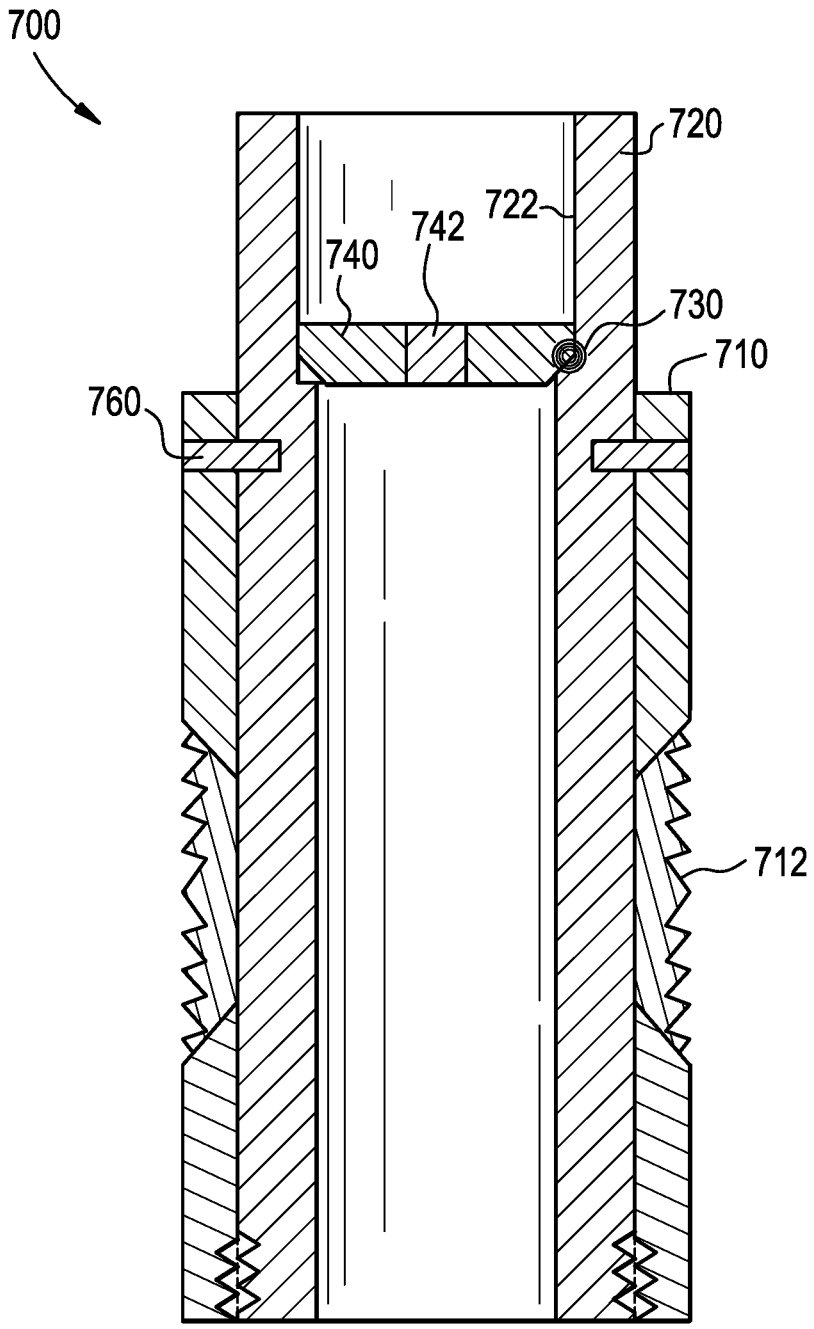
FIG. 7 depicts a frac plug, according to an embodiment.

FIG. 7 depicts frac plug 700, according to an embodiment. Elements depicted in FIG. 7 may be described above, and for the sake of brevity another description of these elements may be omitted.

As depicted in FIG. 7, flapper 740 and rupture disc 742 may be configured to be positioned closer to a proximal end of inner mandrel 720, which may be positioned above a proximal end of outer mandrel 710. Furthermore, an indentation 722 that increases the inner diameter across inner mandrel 720 may be positioned at the proximal end of inner mandrel 720, wherein the indentation is configured to receive flapper 740 when flapper is in the second position. By positioning indentation 722 at a proximal end of inner mandrel 720, a piston area may be created at the proximal end of inner mandrel 720, which may assist in generating the pressure necessary to burst rupture disc 742. In another embodiment, rupture disc 742 may be mounted on the flapper 740 in an angle with the down stream directed toward the slips 712 location. This may allow fluid exiting the rupture disc 742 as it shears to erode the inner/outer mandrel supporting the slips 712 and causing the slips 712 to erode and fail.

Figure 8:
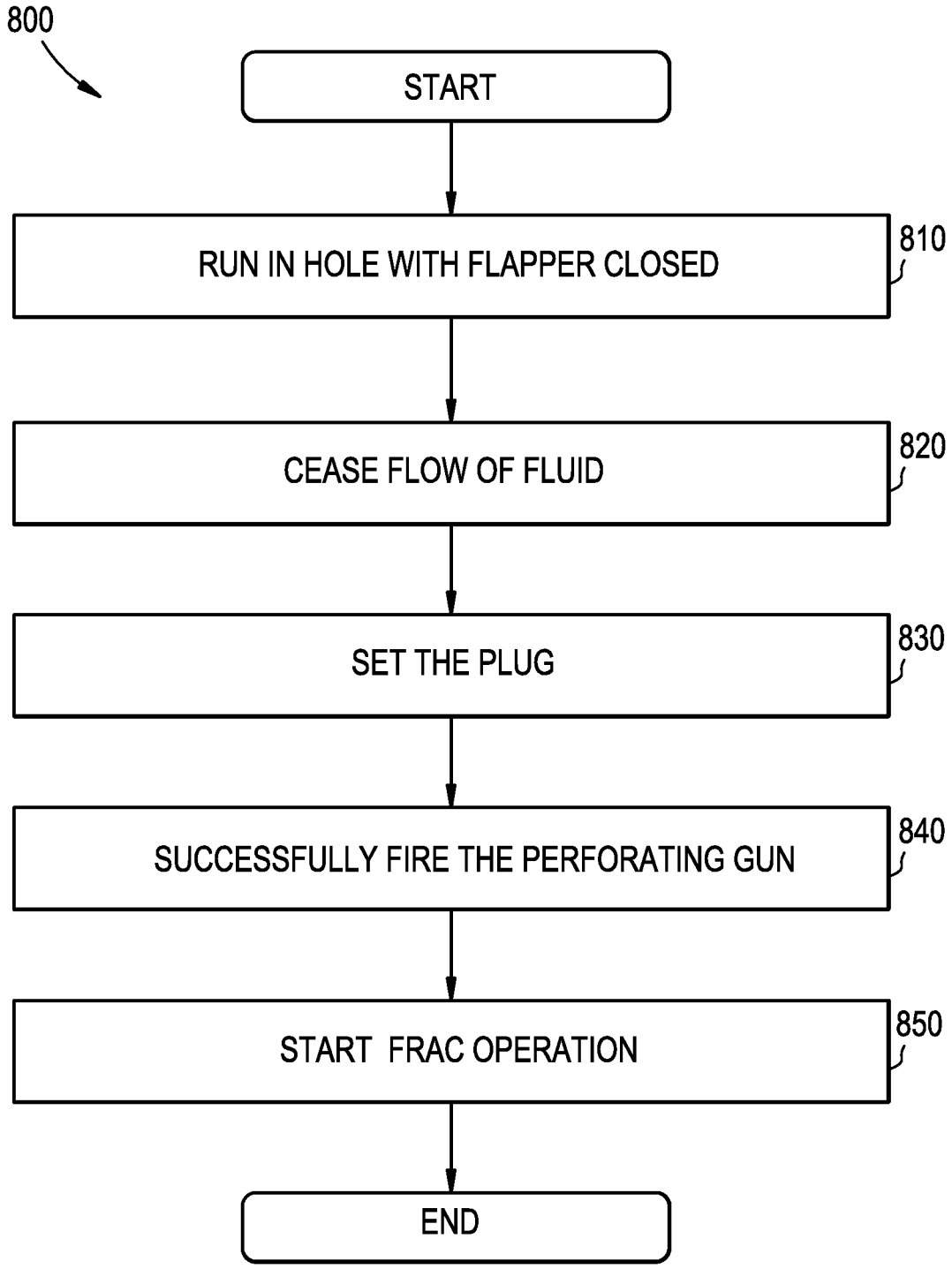
FIG. 8 depicts a method for utilizing a plug, according to an embodiment.

FIG. 8 depicts a method 800 for utilizing a frac plug. The operations of method 800 presented below are intended to be illustrative. In some embodiments, method 800 may be accomplished with one or more additional operations not described, and/or without one or more of the operations discussed. Additionally, the order in which the operations of method 800 are illustrated in FIG. 8 and described below is not intended to be limiting. Furthermore, the operations of method 800 may be repeated for subsequent valves or zones in a well.

At operation 810, a frac plug may be run in hole. The frac plug may be run in hole while a flapper is positioned across the inner diameter of the frac plug to form a seal. This may reduce the amount of fluid required to pump the frac plug downhole.

At operation 820, the frac plug may be initially set by reducing the flow of fluid through the inner diameter of the plug. Responsive to ceasing the flow of fluid through the frac plug, the flapper may move to rest in a position that is not perpendicular to the central axis of the frac plug. This may allow for a partial opening across the inner diameter of the tool.

At operation 830, the flow of fluid through the inner diameter of the tool. This may cause the flapper to set to form a seal across an inner diameter of the frac plug.

At operation 840, a perforating gun may be successfully fired, which opens up perforations in a casing and/or a geological formation positioned before the frac plug.

At operation 850, a fracturing operation may occur. The fracturing operation may utilize a pressure that is less than a pressure threshold associated with the rupture disc positioned within the flapper. This may allow the rupture disc to remain intact during the fracturing operation.

At operation 840, responsive to the pressure threshold being exceeded, the rupture disc may shear exposing a passageway through the flapper.

Figure 9:
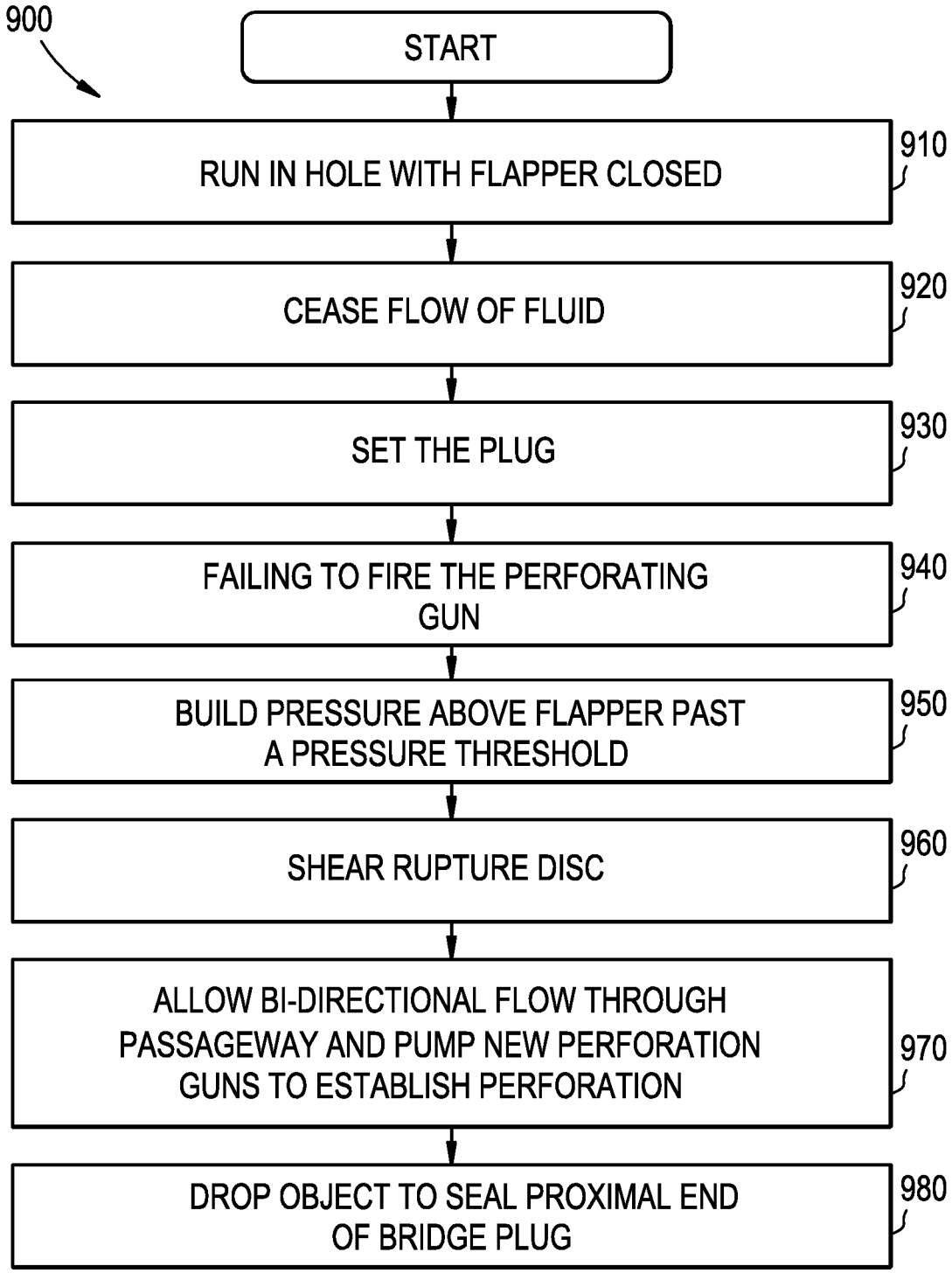
FIG. 9 depicts a method for utilizing a plug, according to an embodiment.

FIG. 9 depicts a method 800 for utilizing a frac plug. The operations of method 900 presented below are intended to be illustrative. In some embodiments, method 900 may be accomplished with one or more additional operations not described, and/or without one or more of the operations discussed. Additionally, the order in which the operations of method 800 are illustrated in FIG. 9 and described below is not intended to be limiting. Furthermore, the operations of method 900 may be repeated for subsequent valves or zones in a well.

At operation 910, a frac plug may be run in hole. The frac plug may be run in hole while a flapper is positioned across the inner diameter of the frac plug to form a seal. This may reduce the amount of fluid required to pump the frac plug downhole.

At operation 920, the frac plug may be initially set by reducing the flow of fluid through the inner diameter of the plug. Responsive to ceasing the flow of fluid through the frac plug, the flapper may move to rest in a position that is not perpendicular to the central axis of the frac plug. This may allow for a partial opening across the inner diameter of the tool.

At operation 930, the flow of fluid through the inner diameter of the tool may increase to be past a pressure threshold. This may cause the flapper to set to form a seal across an inner diameter of the frac plug.

At operation 940, a perforating gun may be unsuccessfully fired. This may require further tools to be pumped downhole.

At operation 950, while the flapper creates a seal across the inner diameter of the frac plug, a pressure above the flapper may increase past a pressure threshold.

At operation 960, responsive to the pressure above the flapper increasing past a pressure threshold. This may cause the rupture disc to shear, exposing a passageway through the flapper.

At operation 970, bi-directional fluid may flow through the passageway, which may allow fluid to flow from a proximal end of the frac plug towards a distal end of the frac plug. This may enable additional tools to be pumped downhole without creating a fluid lock. In embodiments, if fluid flows in a direction from the distal end of the tool towards the proximal end of the tool at a flow rate that is higher than a flow rate threshold, the flapper may rotate to be positioned in parallel to a central axis of the frac plug.

At operation 980, an additional object may be positioned on an inner mandrel of the frac plug to form a seal across the inner diameter of the frac plug.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

The invention claimed is:

1. A method for utilizing a frac plug, the method comprising:

positioning a flapper in a first position, wherein the first position the flapper crosses a central axis of the frac plug;

moving the flapper from the first position to a second position, wherein in the second position the flapper does not cross the central axis of the frac plug;

increasing a pressure above the frac plug to a first pressure;

increasing the pressure above the frac plug to a second pressure;

removing a component from a passageway responsive to the pressure above the frac plug increasing to the second pressure, wherein the second pressure is greater than the first pressure.

2. The method of claim 1, wherein the flapper is a blocking device.

3. The method of claim 1, wherein in a second position the flapper is positioned at an angle that is between a first direction parallel to the central axis of the frac plug and a second direction perpendicular to the central axis of the frac plug when no fluid is flowing through the frac plug.

4. The method of claim 1, wherein the second pressure is less or equal to a pressure rating of the frac plug.

5. The method of claim 1, further comprising:

flowing fluid from a distal end of the frac plug to a proximal end of the frac plug;

moving the flapper from the first position to a second position based on the fluid flowing from the distal end to the proximal end.

6. The method of claim 1, further comprising:

positioning the flapper in the first position while the frac plug is being run in hole.

7. The method of claim 1, wherein the flapper is comprised of at least one of a dissolvable material, composite material or cast iron.

8. The method of claim 1, wherein the flapper is positioned inside a mandrel of the frac plug.

9. A method for utilizing a frac plug, the method comprising:

positioning a flapper in a first position, wherein the first position the flapper crosses a central axis of the frac plug;

increasing a pressure above the frac plug to a first pressure;

increasing the pressure above the frac plug to a second pressure;

removing a component from a passageway responsive to the pressure above the frac plug increasing to the second pressure, wherein the second pressure is greater than the first pressure, wherein when the component is removed from the passageway, fluid can flow through an inner mandrel of the frac plug.

10. The method of claim 9, further comprising:

flowing the fluid from a distal end of the frac plug to a proximal end of the frac plug through the passageway.

11. A system for a fracturing operation, the system comprising:

a frac plug;

a flapper configured to move between a first position and a second position, wherein the first position the flapper crosses a central axis of the frac plug;

a pressure above the frac plug that is increased to a first pressure to perform the fracturing operation;

a removeable component configured to be removed responsive to increasing a pressure within the frac plug to a second pressure wherein the second pressure is greater than the first pressure.

12. The system of claim 11, wherein the flapper is a blocking device.

13. The system of claim 12, wherein the fluid is configured to flow from a distal end of the frac plug to a proximal end of the frac plug through the passageway.

14. The system of claim 11, wherein in the second position the flapper does not cross the central axis of the frac plug.

15. The system of claim 11, wherein when the component is removed from a passageway, fluid can flow through an inner mandrel of the frac plug.

16. The system of claim 11, wherein in a second position the flapper is positioned at an angle that is between a first direction parallel to the central axis of the frac plug and a second direction perpendicular to the central axis of the frac plug when no fluid is flowing through the frac plug.

17. The system of claim 11, wherein the second pressure is less or equal to a pressure rating of the frac plug.

18. The system of claim 11, wherein the flapper is configured to move from the first position to a second position based on fluid flowing from a distal end of the frac plug to a proximal end of the frac plug.

19. The system of claim 11, wherein the flapper is positioned in the first position while the frac plug is being run in hole.

20. The system of claim 11, wherein the flapper is comprised of at least one of a dissolvable material, composite material or cast iron.

21. The system of claim 11, wherein the flapper is positioned inside a mandrel of the frac plug.

* * * * *